US009581927B2

(12) United States Patent
Iwakawa et al.

(10) Patent No.: US 9,581,927 B2
(45) Date of Patent: Feb. 28, 2017

(54) IMAGE FORMING APPARATUS HAVING DETECTION OF SEPARATION FAILURE JAMS

(75) Inventors: Tadashi Iwakawa, Abiko (JP); Keitaro Taoka, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 361 days.

(21) Appl. No.: 13/363,678

(22) Filed: Feb. 1, 2012

(65) Prior Publication Data

US 2012/0207485 A1 Aug. 16, 2012

(30) Foreign Application Priority Data

Feb. 10, 2011 (JP) ..... 2011-026764

(51) Int. Cl.
*G03G 15/16* (2006.01)
*G03G 15/01* (2006.01)
(Continued)

(52) U.S. Cl.
CPC ..... *G03G 15/0189* (2013.01); *G03G 15/6564* (2013.01); *G03G 15/6567* (2013.01);
(Continued)

(58) Field of Classification Search
CPC ..... G03G 15/00; G03G 15/0189; G03G 15/6564; G03G 15/70; G03G 21/00; B65H 7/02
(Continued)

(56) References Cited

U.S. PATENT DOCUMENTS 6,347,196 B1 * 2/2002 Kawabata et al. ..... 399/16
7,274,904 B2 * 9/2007 Yasui ..... 399/388
(Continued)

FOREIGN PATENT DOCUMENTS

JP 11-59962 A 3/1999
JP 2008081254 A * 4/2008
JP 2010008879 A * 1/2010

*Primary Examiner* — Blake A Tankersley
*Assistant Examiner* — Quang X Nguyen
(74) *Attorney, Agent, or Firm* — Fitzpatrick, Cella, Harper & Scinto

(57) ABSTRACT

An image forming apparatus includes a primary transfer unit, a secondary transfer unit, a registration roller pair placed upstream of the secondary transfer unit in a sheet transport direction, and a drive unit driving the registration roller pair. In addition, a detection sensor unit is placed on a sheet transport path downstream of the secondary transfer unit and detects a sheet transported after a toner image is secondary transferred by the secondary transfer unit, and a transport unit transports the sheet after the secondary transfer. A control unit stops the drive unit when it determines absence of the sheet on the sheet transport path based on a signal from the detection sensor unit when a predetermined time based on an interval of time, which is from when the control unit controls the drive unit and starts to transport the sheet by the registration roller pair to when a leading edge of the sheet reaches the detection sensor unit, has elapsed, or when an interval of time, which is taken from when the control unit controls the drive unit and starts to transport the sheet by the registration roller pair to when the leading edge of the sheet reaches the transport unit, has elapsed.

17 Claims, 14 Drawing Sheets

(51) Int. Cl.
*G03G 15/00* (2006.01)
*G03G 15/23* (2006.01)

(52) U.S. Cl.
CPC ..... *G03G 15/70* (2013.01); *G03G 15/235* (2013.01); *G03G 2215/00548* (2013.01); *G03G 2215/0129* (2013.01)

(58) Field of Classification Search
USPC ..... 399/21–23, 66, 397, 398, 405, 388
See application file for complete search history.

(56) References Cited

U.S. PATENT DOCUMENTS

| | | | | |
|---|---|---|---|---|
| 2004/0188919 | A1* | 9/2004 | Sakamaki ..... | B65H 3/5261 271/122 |
| 2006/0222386 | A1* | 10/2006 | Koshida ..... | G03G 15/657 399/44 |
| 2009/0279906 | A1* | 11/2009 | Kuma et al. ..... | 399/21 |

* cited by examiner

IMAGE FORMING APPARATUS HAVING DETECTION OF SEPARATION FAILURE JAMS

BACKGROUND OF THE INVENTION

Field of the Invention

The present invention relates to an electrophotographic image forming apparatus, and more particularly, to an image forming apparatus which forms images on sheets using an intermediate transfer belt.

Description of the Related Art

An image forming apparatus which uses an intermediate transfer belt has as many (e.g., four) image bearing members (photosensitive members) as the number of colors needed for image formation. A charging unit, an exposure unit, and a developer unit are arranged around each image bearing member. Single color toner images formed on the respective image bearing members are transferred (primarily transferred) in superimposition onto the intermediate transfer belt, and then the toner images primarily transferred onto the intermediate transfer belt are secondarily transferred onto a sheet of plain paper or the like, thereby forming an unfixed image on the sheet. The sheet with the unfixed image formed thereon is transported to a fixing unit which then fixes the unfixed image. Then, the sheet is discharged from the image forming apparatus.

Recent image forming apparatus are expected to support sheets of various sizes and basis weights. However, with conventional image forming apparatus, after secondary transfer of toner images from the intermediate transfer belt, for example, sheets with a basis weight of less than 52 gsm (thin sheets) or low-rigidity (low-stiffness) sheets can cause a paper jam without being separated from a surface of the intermediate transfer belt (hereinafter referred to as a separation failure jam). When a separation failure jam occurs, the sheet could get into a place outside a sheet transport path while remaining stuck to the intermediate transfer belt. This might make it difficult to recover the jam or might result in a failure of the image forming apparatus.

To deal with this, a technique has been proposed that involves installing separation claws which can contact with and separate from a belt surface of the intermediate transfer belt to separate the sheet from the belt surface in case of a separation failure jam and thereby prevent the sheet from getting into a place outside the sheet transport path. However, when the separation claws are installed, the separation claws might damage the belt surface of the intermediate transfer belt, which could cause image defects.

To deal with a separation failure jams of the sheet, Japanese Patent Application Laid-Open No. H11-59962 proposes a technique which involves installing a detection sensor for detecting a separation failure jam at a position facing the belt surface of the intermediate transfer belt and downstream of a secondary transfer position in a rotation direction of the intermediate transfer belt. Since any sheet which has caused a separation failure jam gets into a place outside the sheet transport path of the image forming apparatus while remaining stuck to the intermediate transfer belt, the detection sensor causes the image forming apparatus to stop upon detection of a sheet stuck to the intermediate transfer belt. Then, the user can remove the sheet which has caused a separation failure jam.

When a detection sensor is installed at a position facing the belt surface of the intermediate transfer belt, as with the image forming apparatus described in Japanese Patent Application Laid-Open No. H11-59962, problems such as described below arise.

Since a sensor surface of the detection sensor is close to the intermediate transfer belt, the sensor surface of the detection sensor is prone to get contaminated with toner scattering from transfer residual toner or toner patches adhering to the transfer belt, which could cause misdetection. When a separation failure jam occurs, a sheet with an unfixed toner image transferred thereon is passing between the intermediate transfer belt and the detection sensor. After that, depending on the condition or pull-out direction of the jammed sheet, the sensor surface of the detection sensor could get contaminated with toner when jam recovery is performed. Furthermore, a surface opposing the detection sensor is the intermediate transfer belt which is normally black. This makes it difficult to set a threshold value used to distinguish sheets for as much as transfer residual toner and toner patches needed for control pass on the belt surface. In particular, a separation failure jam is liable to occur on the second side (another side) of thin paper when a fixed toner image is on the first side (one side) of the thin paper. For example, in the case of thin paper 100 μm or less in thickness, detection based on an amount of displacement of the belt surface is difficult when fluttering of the belt surface is considered.

SUMMARY OF THE INVENTION

The present invention provides an image forming apparatus which forms images on sheets by using an intermediate transfer belt, the image forming apparatus improving detection accuracy of separation failure jams with reduced misdetections of separation failure jams.

The present invention provides an image forming apparatus which primarily transfers a toner image formed on an image bearing member onto an intermediate transfer belt, and then secondarily transfers the primarily transferred toner image onto a sheet and forms an image on the sheet, including: a secondary transfer unit secondarily transferring the toner image, which is primarily transferred onto the intermediate transfer belt, onto the sheet; a registration roller pair placed upstream of the secondary transfer unit in a sheet transport direction and starting to transport the sheet in synchronization with secondary transferring the toner image onto the sheet by the secondary transfer unit; a drive unit driving the registration roller pair; a detection sensor placed on a sheet transport path downstream of the secondary transfer unit in the sheet transport direction and detecting the sheet transported after the toner image is secondary transferred by the secondary transfer unit; a transport unit placed downstream of the detection sensor and transporting the sheet after the secondary transfer; and a control unit controlling to stop the drive unit in a case that the control unit determines absence of the sheet on the sheet transport path based on a signal from the detection sensor, when an interval of time, which is expected to be taken from when the control unit controls the drive unit and starts to transport the sheet by the registration roller pair to when a leading edge of the sheet reaches the transport unit, has elapsed.

Also, the present invention provides an image forming apparatus which primarily transfers a toner image formed on an image bearing member onto an intermediate transfer belt, and then secondarily transfers the primarily transferred toner image onto a sheet and forms an image on the sheet, including: a secondary transfer unit secondarily transferring the toner image, which is primarily transferred onto the intermediate transfer belt, onto the sheet; a registration roller pair placed upstream of the secondary transfer unit in a sheet transport direction and starting to transport the sheet in synchronization with secondary transferring the toner image onto the sheet by the secondary transfer unit; a drive unit driving the registration roller pair; a detection sensor placed on a sheet transport path downstream of the secondary transfer unit in the sheet transport direction and detecting the sheet transported after the toner image is secondary transferred by the secondary transfer unit; a transport unit placed downstream of the detection sensor and transporting the sheet after the secondary transfer; and a control unit controlling to stop the drive unit in a case that the control unit determines absence of the sheet on the sheet transport path based on a signal from the detection sensor, when a predetermined interval of time, which is expected to be taken from when the control unit controls the drive unit and starts to transport the sheet by the registration roller pair to when a rear edge of the sheet is spaced apart from a nip of the registration roller pair at predetermined distance, has elapsed.

Further features of the present invention will become apparent from the following description of exemplary embodiments with reference to the attached drawings.

DESCRIPTION OF THE EMBODIMENTS

An image forming apparatus according to an embodiment of the present invention will be described below with reference to the drawings, where the image forming apparatus has an intermediate transfer belt. The image forming apparatus according to the present embodiment is an intermediate transfer type image forming apparatus, such as a copier, printer, facsimile machine, or multi-function peripheral thereof, which primarily transfers toner images onto an intermediate transfer belt once, and then secondarily transfers the toner images onto a sheet. An intermediate transfer type image forming apparatus with image forming units of four colors arranged above an intermediate transfer belt will be described in the following embodiments.

First Embodiment

Figure 1:
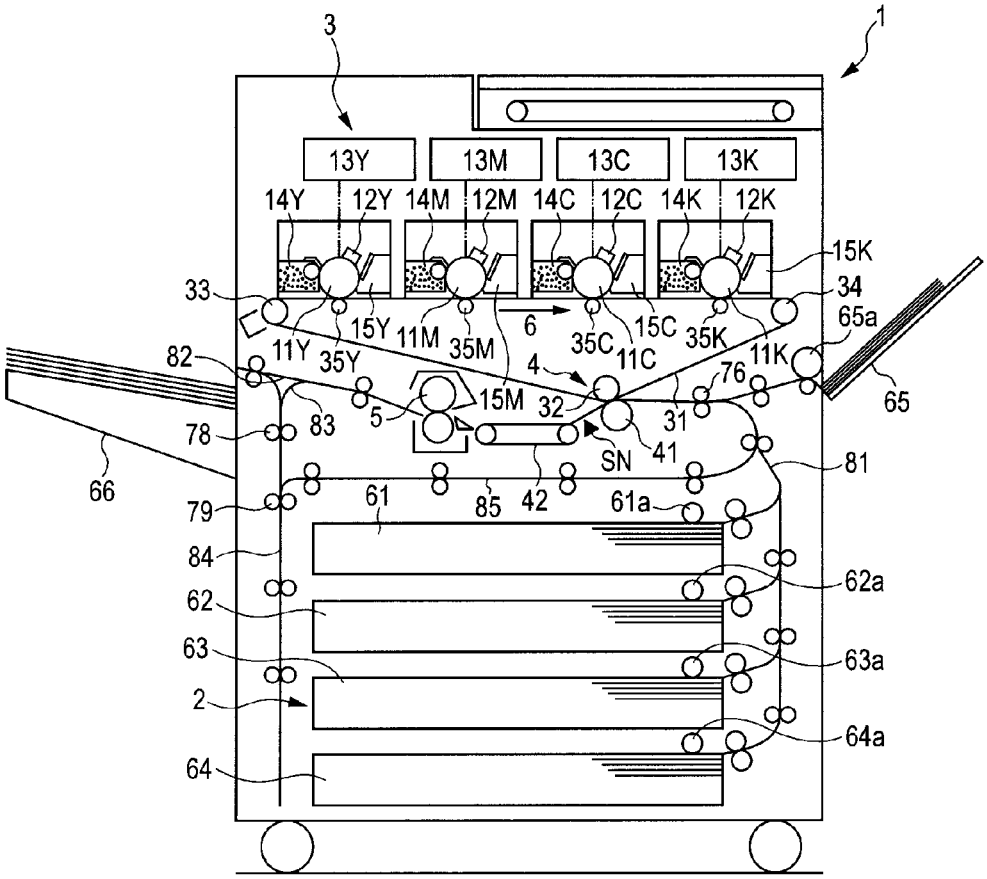
FIG. 1 is a sectional view schematically showing an overall structure of an image forming apparatus according to an embodiment of the present invention.
Figure 2:
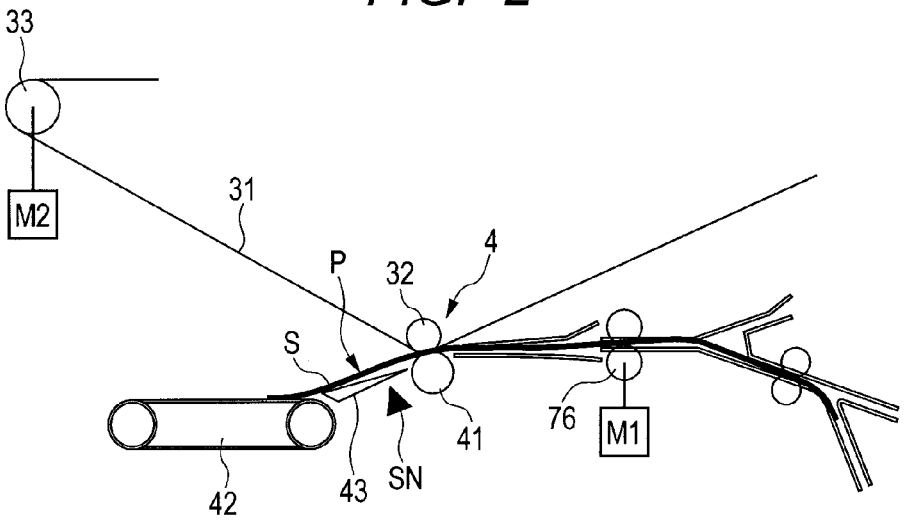
FIG. 2 is a partially enlarged view schematically showing a secondary transfer unit of the image forming apparatus according to the present embodiment.

An image forming apparatus 1 according to a first embodiment of the present invention will be described with reference to FIGS. 1 to 6. First, an overall configuration of the image forming apparatus according to the first embodiment will be described with reference to FIGS. 1 and 2. FIG. 1 is a sectional view schematically showing an overall structure of the image forming apparatus 1 according to an embodiment of the present invention. FIG. 2 is a partially enlarged view schematically showing a secondary transfer unit 4 of the image forming apparatus 1 according to the present embodiment.

As shown in FIG. 1, the image forming apparatus 1 includes a sheet feeding unit 2 adapted to feed sheets S, an image forming section 3 adapted to form toner images to be transferred to the sheets S, an intermediate transfer belt 31 onto which the toner images are primarily transferred, and a secondary transfer unit 4 adapted to secondarily transfer the toner images onto the sheets S. Together with the configuration of the image forming apparatus, processes will be described below, focusing on a transport process of the sheets S transported to the secondary transfer unit 4 by the sheet feeding unit 2, an image forming process by the image forming section 3, a secondary transfer process by the secondary transfer unit 4, and subsequent processes.

The transport process by the sheet feeding unit 2 which involves transporting the sheets S to the secondary transfer unit 4 will be described. The sheets S are contained in paper cassettes 61, 62, 63 and 64 installed in lower part of the image forming apparatus 1 and are fed from the respective paper cassettes 61 to 64 by feed rollers 61*a*, 62*a*, 63*a* and 64*a*. According to the present embodiment, a manual feed tray 65 adapted to allow manual feeding is installed on a flank of the image forming apparatus 1, and the sheets S can be fed from the manual feed tray 65 by a feed roller 65*a*.

The sheets S fed by the feed rollers 61*a* to 65*a* are separated one by one by a separation unit and transported through a transport path 81 to a registration roller pair 76 placed upstream of the secondary transfer unit 4 in a sheet transport direction. The registration roller pair 76 causes a leading edge of the sheet S fed from any of the paper cassettes 61 to 64 to abut against a nip and thereby causes the sheet S to form a predetermined loop (see FIG. 4A described later). The formation of the loop causes the leading edge of the sheet S to follow the nip of the registration roller pair 76, thereby correcting a skew of the sheet S. The registration roller pair 76 transports the sheet S to the secondary transfer unit 4 with a timing of image formation on the sheet S i.e., a predetermined timing in synchronization with toner images formed on photosensitive members (described later) serving as image bearing members and primarily transferred onto the intermediate transfer belt 31. The registration roller pair 76 corrects a skew of the sheet S and starts transporting the sheet with the predetermined timing. As shown in FIG. 2, the registration roller pair 76 is electrically connected to a registration roller drive motor (hereinafter referred to as the "registration motor") M1, and the registration roller pair 76 is driven to rotate by the registration motor M1.

Next, the image forming process of the image forming section 3 will be described. The image forming section 3 forms toner images to be primarily transferred onto the intermediate transfer belt 31. The image forming section 3 includes photosensitive members 11 (11Y, 11M, 11C and 11K), charging units 12 (12Y, 12M, 12C and 12K), exposure units 13 (13Y, 13M, 13C and 13K), and developing units 14 (14Y, 14M, 14C and 14K). Also, the image forming section 3 includes primary transfer units 35 (35Y, 35M, 35C and 35K) and photosensitive member cleaners 15 (15Y, 15M, 15C, 15K).

Based on received image information signal, the exposure units 13 irradiate with the photosensitive members rotating with their surfaces charged uniformly by the charging units 12 in advance, thereby forming electrostatic latent images on the photosensitive members 11. The electrostatic latent images formed on the photosensitive members 11 are developed with toner by the developing units 14, thereby forming toner images on the photosensitive members 11. Once the toner images are formed, the primary transfer units 35 apply predetermined pressing force and electrostatic load bias to the toner images. Consequently, the toner images are primarily transferred onto the intermediate transfer belt 31.

A small amount of transfer residual toner remaining on the photosensitive members 11 is collected by the photosensitive member cleaners 15 to prepare for next image formation. The image forming section 3 according to the present embodiment includes image forming units (photosensitive members 11, charging units 12, exposure units 13, developing units 14 and primary transfer units 35) of four colors: yellow (Y), magenta (M), cyan (C) and black (Bk). The image forming units of four colors: yellow (Y), magenta (M), cyan (C) and black (Bk), transfer (primarily transfer) single color toner images formed on the image bearing members from upstream onto the intermediate transfer belt 31 in superimposition. Consequently, a full-color toner image is finally transferred onto the intermediate transfer belt 31 and transported to the secondary transfer unit 4.

The intermediate transfer belt 31 bears the toner images formed by the image forming section 3 and primarily transferred, and transports the toner images to the secondary transfer unit in synchronization with the transport process of the sheet. The intermediate transfer belt 31 is looped around a drive roller 33, a tension roller 34 and an inner secondary transfer roller 32, and adapted to rotate in the direction of arrow B in FIG. 1 by the drive roller 33 being rotationally driven. The drive roller 33 is electrically connected to an intermediate transfer belt drive motor (hereinafter referred to as the "ITB motor") M2, and rotationally driven by the ITB motor.

Next, the secondary transfer process by the secondary transfer unit 4 and subsequent processes will be described. The secondary transfer unit 4 includes the inner secondary transfer roller 32 and an outer secondary transfer roller 41 opposing to the inner secondary transfer roller 32. The secondary transfer unit 4 applies predetermined pressing force and electrostatic load bias to the sheet S in a nip between the inner secondary transfer roller 32 and outer secondary transfer roller 41 and thereby secondarily transfers the toner image to the sheet S.

Once the full-color toner image is secondarily transferred onto the sheet S by the secondary transfer unit 4, the sheet S is transported to a fixing unit 5 by a suction transport belt 42 serving as a suction transport unit. The suction transport belt 42 is provided with an innumerable number of air suction holes, rotatably looped around a transport belt drive roller and transport belt tension roller, and driven to rotate in a transport direction of sheet S from the secondary transfer unit 4 to the fixing unit 5. The suction transport belt 42 transports the sheet S while making the sheet S sucked onto a suction transport belt surface under negative pressure created by a fan. A sheet transport path P between the secondary transfer unit 4 and the suction transport belt 42, which is placed downstream of the secondary transfer unit 4 in the sheet transport direction, is defined by a lower guide 43 placed between the secondary transfer unit 4 and suction transport belt 42. Since the toner image is transferred to a top surface of the sheet by the secondary transfer unit 4, no upper guide for guiding the top surface is provided above the lower guide 43. Therefore, the sheet is guided along the top surface of the lower guide 43.

A detection sensor SN (post-transfer sensor), which detects whether or not a sheet transported along the sheet transport path P after secondary transferring, is placed under the sheet transport path P which guides the sheet from the secondary transfer unit 4 to the suction transport belt 42. The detection sensor SN is a reflective type sensor adapted to emit light, and output a signal when there is a sheet. The detection sensor SN is placed so as to emit light upward from below the sheet transport path P through an opening (not shown) formed in the lower guide 43. A control unit (CPU) 10 described later determines that a separation failure jam has occurred, based on a signal generated by the detection sensor SN with predetermined timing when there is no sheet on the sheet transport path P. A separation failure jam as well as a control operation performed by the control unit (CPU) 10 in case of a separation failure jam will be described in detail later.

The fixing unit 5 applies predetermined pressing force by opposing rollers or a belt, applies heat from a heat source such as a heater, and melts and fixes the toner image on the sheet S. The sheet S with the fixed image is delivered onto a delivery tray 66 via a delivery transport path 82. In the case where images are formed on both sides of a sheet, the sheet S is transported to a reverse path 83 and then drawn into a switchback path 84 from the reverse path 83. Then, the rotation direction of a reverse roller pair 79 is reversed (switchback operation), thereby interchanging the leading edge and rear edge of the sheet S, and consequently the sheet S is transported to a duplex transport path 85.

Subsequently, the sheet S rejoins in synchronization with a sheet S of a subsequent job fed from the paper cassettes 61 to 64 or manual feed tray 65, and is then transported to the secondary transfer unit 4 via the registration roller pair 76. An image forming process on the back side (second side) is similar to the image forming process on the front side (first side) described above, and thus description thereof will be omitted. In the case where the sheet S is delivered in reverse, the sheet S is drawn into the switchback path 84 from the reverse path 83 after passing the fixing unit 5. Then, both reverse roller pair 78 and reverse roller pair 79 are reversed, and the rear edge of the incoming sheet is turned forward. Then, the sheet is caused to go out in a direction opposite to the incoming direction and delivered onto the delivery tray 66.

Figure 3A:
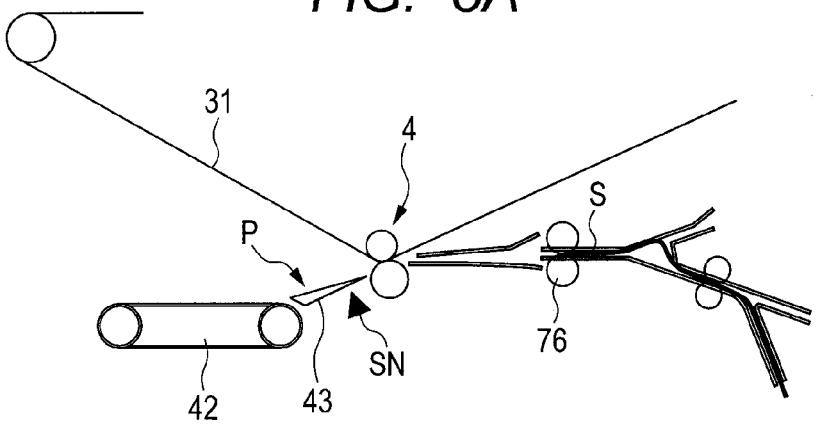
FIG. 3A shows a state in which a sheet forms a loop to correct skew.
Figure 3B:
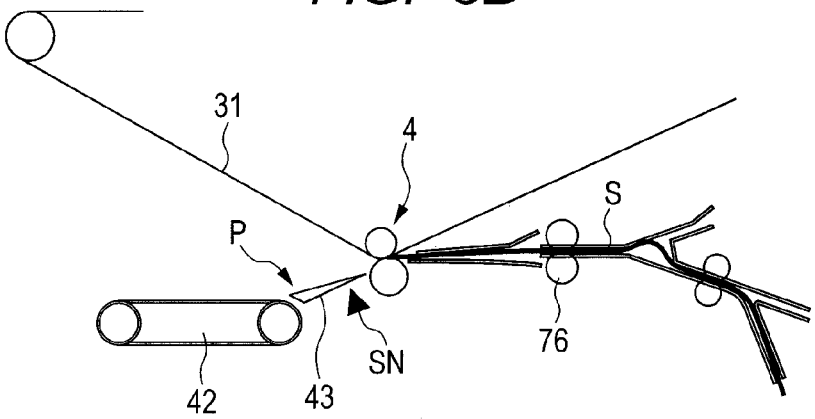
FIG. 3B shows a state in which a sheet has been transported to the secondary transfer unit with predetermined timing.
Figure 3C:
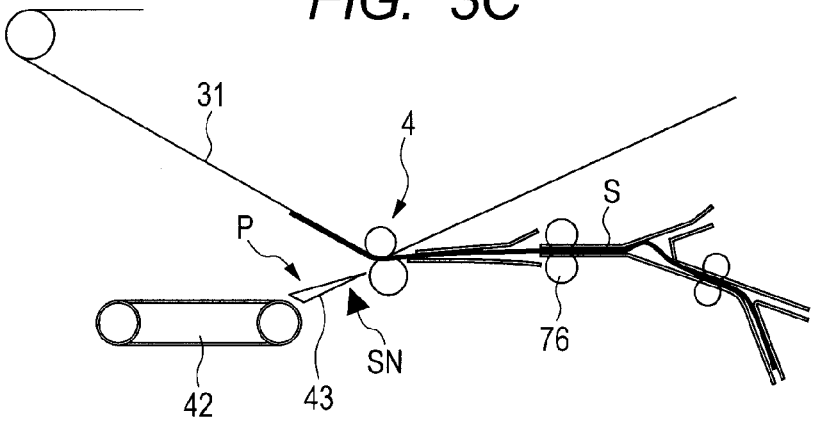
FIG. 3C shows a state in which a sheet is transported without being separated from an intermediate transfer belt.
Figure 4A:
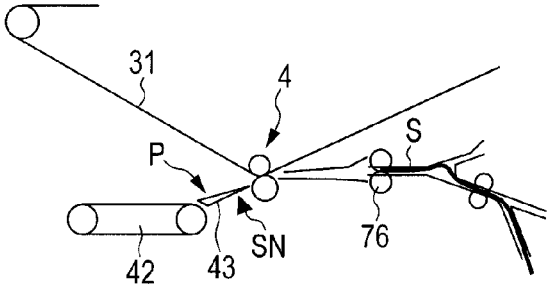
FIG. 4A shows a state in which a sheet forms a loop to correct skew.
Figure 4B:
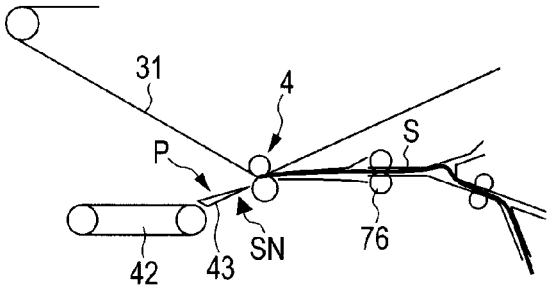
FIG. 4B shows a state in which a sheet has been transported to the secondary transfer unit with predetermined timing.
Figure 4C:
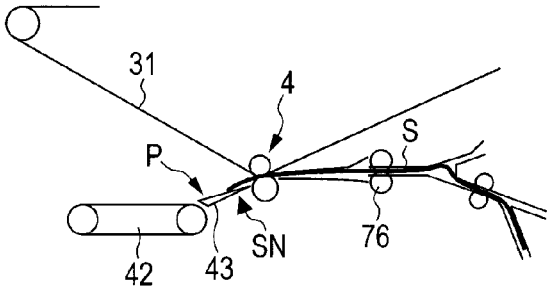
FIG. 4C shows a state in which a leading edge of a sheet contacts with a detection sensor.
Figure 4D:
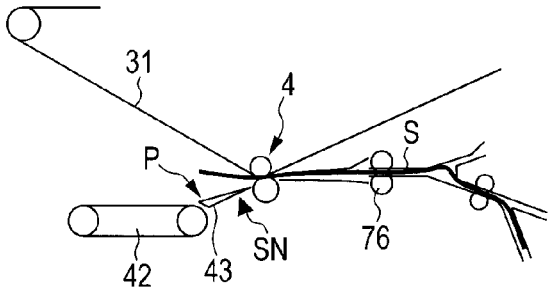
FIG. 4D shows a state in which the sheet contacted with the detection sensor is drawn to the intermediate transfer belt.
Figure 4E:
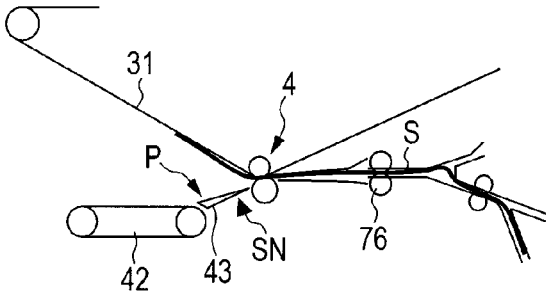
FIG. 4E shows a state in which the sheet drawn to the intermediate transfer belt is transported by sticking to the intermediate transfer belt.

Next, with reference to FIGS. 3A to 6, description will be given of stop control performed by the control unit 10 of the image forming apparatus 1 in case of a sheet separation failure jam. First, a separation failure jam will be described with reference to FIGS. 3A to 4E. FIG. 3A shows a state in which the sheet S forms a loop to correct skew. FIG. 3B shows a state in which the sheet S is transported to the secondary transfer unit 4 with predetermined timing. FIG. 3C shows a state in which the sheet S is transported without being separated from the intermediate transfer belt 31. FIG. 4A shows a state in which the sheet S forms a loop to correct skew. FIG. 4B shows a state in which the sheet S is transported to the secondary transfer unit 4 with predetermined timing. FIG. 4C shows a state in which the leading edge of the sheet S can be detected by the detection sensor SN. FIG. 4D shows a state in which the sheet is drawn to the intermediate transfer belt 31 by getting out of the state in which the sheet S can be detected by the detection sensor SN. FIG. 4E shows a state in which the sheet S drawn to the intermediate transfer belt 31 is transported while sticking to the intermediate transfer belt 31.

As shown in FIG. 3A, the sheet S fed from any of the paper cassettes 61 to 64 forms a loop by abutting against the nip of the registration roller pair 76, thereby causes the leading edge of the sheet S to follow the nip and a skew is corrected. After the skew of the sheet S is corrected, the sheet S waits at the registration roller pair 76 so that the sheet S is sent out to the secondary transfer unit 4 in synchronization with image formation of the image forming section 3. Subsequently, as shown in FIG. 3B, the sheet S is transported to the secondary transfer unit 4 with predetermined timing in synchronization with the toner images formed by the image forming section 3 and primarily transferred onto the intermediate transfer belt 31.

As shown in FIG. 3C, in the case of a separation failure jam, when the sheet S is not separated from the intermediate transfer belt 31 and is not detected by the detection sensor SN within a predetermined time, the control unit 10 determines that there is a jam. The intermediate transfer belt 31 is coming in contact with the photosensitive members 11. Consequently, even if the ITB motor M2 is stopped after the control unit determines that there is a jam, the intermediate transfer belt 31 cannot be stopped instantly due to inertial force of the photosensitive members 11 as well as inertial force caused by the own weight of the intermediate transfer belt 31. Therefore, for example, a small-size sheet which is short in the transport direction could get into the image forming section 3 by passing over the fixing unit 5 while remaining stuck to a belt surface of the intermediate transfer belt 31. This situation especially occurs in the image forming apparatus being required high productivity for as much as the intermediate transfer belt 31 has a high rotational speed.

Even if the leading edge of the sheet S is separated from the intermediate transfer belt 31, the sheet S has been charged up by the electrostatic load bias applied in the secondary transfer unit 4. Therefore, even if the leading edge of the sheet S is located in such a position where the detection sensor SN can detect it as shown in FIG. 4C, a force tending to draw the sheet S to the belt surface of the intermediate transfer belt 31 is acting on the sheet S as shown in FIG. 4D. Consequently, the sheet S once separated could stick to the belt surface of the intermediate transfer belt 31 again as shown in FIG. 4E.

In this case, since the detection sensor SN has detected the leading edge of the sheet S once, the control unit 10 cannot determine that there is a separation failure jam. Therefore, a jam check is carried out by a next sheet detection sensor placed further downstream of the detection sensor SN, resulting in a delay in the detection of a separation failure jam. Thus, when it is determined that there is a separation failure jam, the leading edge of the sheet S might run out of the sheet transport path P and have already gotten into the image forming section 3 or the like. For example, when a small-size sheet which is short in the transport direction is transported, the entire sheet to the rear edge could get into the image forming section 3 or the like. If the entire sheet S gets into the image forming section 3 or the like, the user cannot recover jam.

Figure 5:
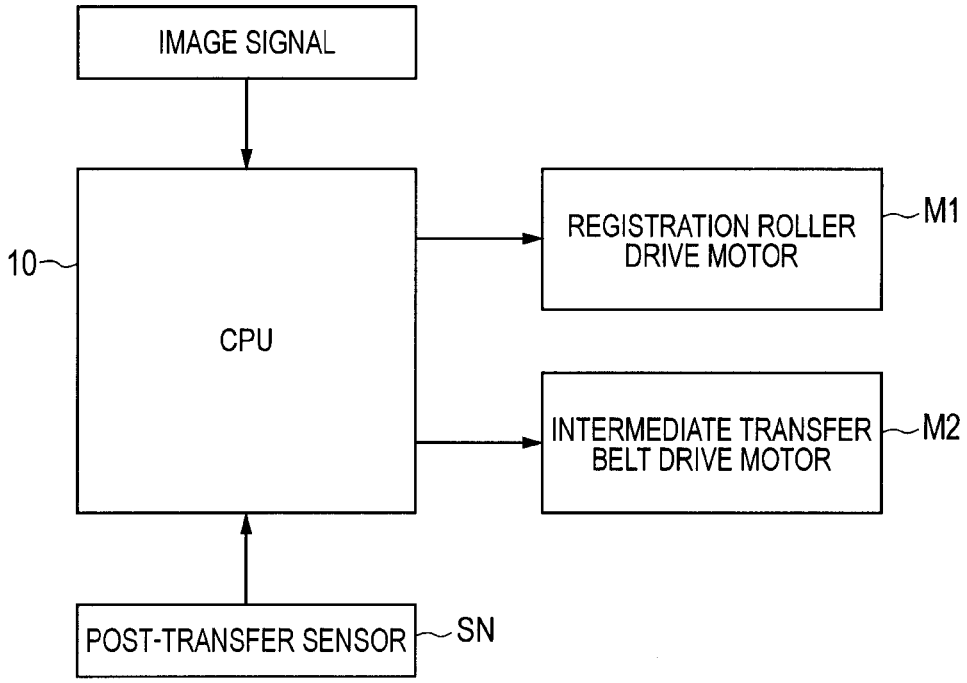
FIG. 5 is a block diagram of a control unit which performs stop control in case of a separation failure jam in an image forming apparatus according to an embodiment.
Figure 6:
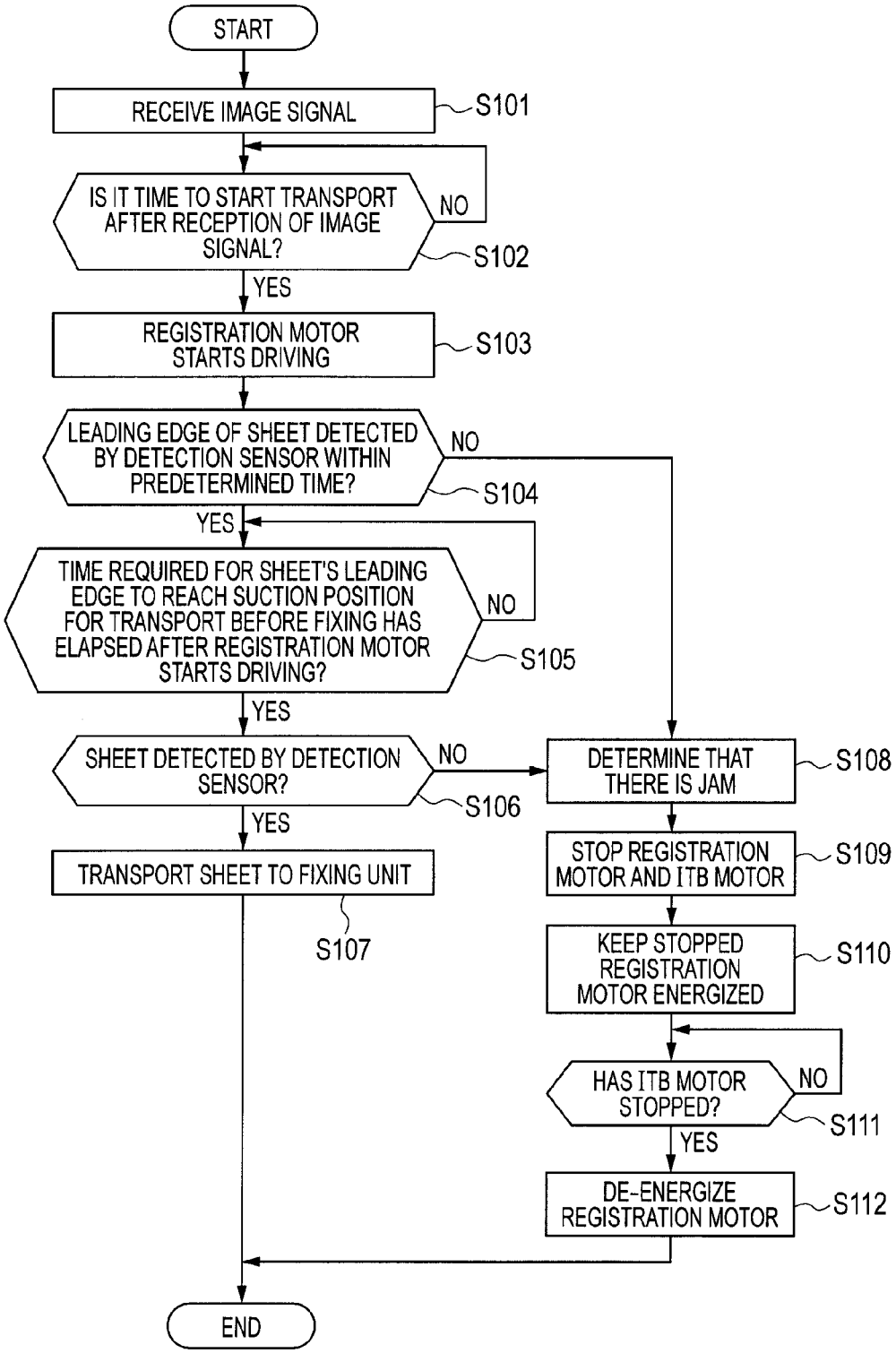
FIG. 6 is a flowchart showing stop control performed by a control unit according to a first embodiment in case of a separation failure jam.

With reference to FIGS. 5 and 6, description will be given of stop control performed by the control unit 10 of the image forming apparatus 1 according to the first embodiment in case of a separation failure jam. FIG. 5 is a block diagram of the control unit 10 which performs stop control in case of a separation failure jam in the image forming apparatus 1 according to the present embodiment. FIG. 6 is a flowchart showing stop control performed by the control unit 10 according to the first embodiment in case of a separation failure jam.

As shown in FIG. 5, the control unit 10 of the image forming apparatus 1 according to the first embodiment is electrically connected to the registration motor M1 and ITB motor M2. When a predetermined image signal is input, the control unit 10 controls driving of the registration motor M1 and ITB motor M2 and performs stop control of the registration motor M1 and ITB motor M2 based on detection of a sheet by the detection sensor SN. The stop control performed by the control unit 10 will be described below.

When the image forming apparatus 1 starts a predetermined print job, a sheet S starts to be transported by a transport process with the sheet feeding unit 2 and the transported sheet S waits at the registration roller pair 76 with its skew corrected. In parallel, the image formation is started by the image forming process with the image forming section 3. When receiving a predetermined image signal (step S101), the control unit 10 waits for timing to start transporting the sheet S which has stopped at the registration roller pair 76 upon reception of the image signal (step S102). When timing to start transporting the sheet S occurs, the control unit 10 starts driving of the registration motor M1 and thereby transports the sheet S waiting at the registration roller pair 76 to the secondary transfer unit 4 (step S103).

A full-color toner image is secondarily transferred onto the sheet S, which is transported to the secondary transfer unit 4 by the registration roller pair 76, by the secondary transfer unit 4, and the sheet S is transported to the suction transport belt 42 installed downstream of the secondary transfer unit 4. The detection sensor SN adapted to detect the presence or absence of a sheet S is placed on the sheet transport path P between the secondary transfer unit 4 and suction transport belt 42, and the sheet S passing through the secondary transfer unit is transported first to a detection position of the detection sensor SN by being guided by the lower guide 43.

The control unit 10 makes a first determination as to the presence or absence of a sheet S on the sheet transport path. Specifically, the control unit 10 makes the determination as to the presence or absence of the sheet S based on whether or not the detection sensor SN has detected the leading edge of the sheet S within a predetermined time after the start of the registration motor M1 (step S104).

The predetermined time (expected time) is determined by adding a margin (e.g., 60 msec) to the nominal time required for the sheet S to be transported to the detection sensor SN on the sheet transport path P after the start of the registration motor M1, where the margin is determined by allowing for variations in sheet transport speed. The variations in the sheet transport speed include, for example, sheet transport speed variations due to part tolerances of the registration roller pair 76 and sheet transport speed variations due to decreases in surface resistance of the registration roller pair 76 resulting from wear as well as variations in the time of arrival at the detection sensor SN due to transport resistance of the sheet transport path, and sheet transport speed variations due to differences in resistance between a transport guide (not shown) and sheets S resulting from differences in the rigidity among the sheets S.

The control unit 10 determines whether or not the sheet has caused a separation failure jam, based on the time at which the leading edge of the sheet is expected to reach the detection sensor SN. The presence or absence of a sheet S on the sheet transport path P is determined first in step S104 for as much as the registration roller pair 76 can be stopped sooner if an obvious separation failure jam can be detected in an early stage. If the registration roller pair 76 can be stopped sooner in case of a separation failure jam, waste of toner can be avoided, for example. Also, entrance of the sheet S into the image forming section 3 can be prevented or made less deep.

When the detection sensor SN detects the leading edge of the sheet S within the predetermined time, the sheet S is transported as it is toward the suction transport belt 42. Next, the control unit 10 calculates the time from when the registration motor M1 is started to when the leading edge of the sheet S reaches the belt surface of the suction transport belt 42. Then, the control unit 10 determines whether or not the calculated time has elapsed (step S105). At the time point (timing) when the calculated time elapses, the control unit 10 causes the detection sensor SN to detect the presence or absence of a sheet S again (step S106). When the control unit 10 determines, based on a detection signal from the detection sensor SN, that there is a sheet S on the sheet transport path P, the sheet S is transported as it is to the fixing unit 5 (step S107), and thereby the predetermined print job is finished.

The reason why the detection sensor SN is again caused to perform detection to check for a separation failure jam even though the leading edge of the sheet S is detected by the detection sensor SN in step S104 is that there can be a case where the sheet S is drawn to the intermediate transfer belt 31, resulting in a jam. For example, as shown in FIGS. 4C to 4E, even after the leading edge of the sheet S is detected by the detection sensor SN, there can be a case where the sheet S is drawn to the intermediate transfer belt 31 and stuck to the belt surface of the intermediate transfer belt 31, resulting in a jam.

The reason why the second detection by the detection sensor SN is performed in timing with the arrival of the leading edge of the sheet S at the belt surface of the suction transport belt 42 is that once the sheet S is sucked onto a surface of the suction transport belt 42, the sheet S will not be drawn to the intermediate transfer belt 31. Although in the present embodiment, the sheet is transported by the suction transport belt 42 after image transfer by the secondary transfer unit 4, the sheet may be transported by another unit such as an electrostatic suction transport mechanism as long as the sheet S can be transported without disturbing the toner image thereon.

When the detection sensor SN does not detect the leading edge of the sheet S within the predetermined time in steps S104 and S106, the control unit 10 determines that there is a separation failure jam (step S108). The control unit 10 stops pulse input to the registration motor M1 immediately and stops the ITB motor M2 as well (step S109).

A stepping motor is used as the registration motor M1 and a DC brushless motor is used as the ITB motor M2. As described above, the intermediate transfer belt 31 cannot be stopped instantly due to the inertial force caused by the own weight of the intermediate transfer belt 31 or the inertial force of the photosensitive members 11 contacting with the intermediate transfer belt 31 even if the ITB motor M2 stops. When current passed through the stepping motor is cut off, although the registration roller pair 76 stops immediately, this does not function as a brake because holding torque is not produced in the registration motor M1. That is, even if the current passed through the stepping motor is simply cut off, when the intermediate transfer belt 31 continues to rotate due to the inertial force and the like, causing the sheet S to be transported by the secondary transfer unit 4, the registration roller pair 76 rotates in association with the sheet S, and the sheet S cannot be stopped. Consequently, the sheet S stuck to the belt surface of the intermediate transfer belt 31 and determined to have caused a separation failure jam gets into the image forming section 3 due to transporting force of the secondary transfer unit 4 until the intermediate transfer belt 31 stops.

According to the present embodiment, the stepping motor which is the registration motor M1 adapted to drive the registration roller pair 76 is kept energized by passing holding current while stopping the pulse input for rotating the stepping motor. The stepping motor is kept energized by passing the holding current therethrough after the pulse input to the stepping motor is stopped, thereby holding torque can be generated as predetermined torque (step S110). When the pulse input to the stepping motor is stopped, the registration roller pair 76, which has a low inertial force, can be stopped instantly in a desired time (e.g., 5 msec). After the stop, the registration roller pair 76 is prevented from rotating by the holding torque of the stepping motor, and consequently the sheet S can be restrained from moving. That is, a braking function is given to the registration roller pair 76 by energizing the stepping motor by passing the holding current through the stepping motor with the pulse input to the stepping motor stopped, thereby the sheet S can be prevented from being transported by sticking to the intermediate transfer belt 31.

The control unit 10 determines whether or not the predetermined time required to stop the ITB motor M2 which drives the intermediate transfer belt 31 has elapsed (step S111). When the predetermined time has elapsed, the control unit 10 de-energizes the registration motor M1 (step S112). Consequently, the braking force of the registration roller pair 76 is relieved, allowing the jammed sheet S to be pulled out from the nip of the registration roller pair 76. The holding torque generated by passing the holding current through the registration motor M1 can be caused to function as a brake, allowing the sheet S to be stopped by being nipped in the nip of the registration roller pair 76. This prevents the sheet S from getting into the image forming section 3 due to the intermediate transfer belt 31 which does not stop immediately even if the ITB motor M2 stops. Since the sheet S can be prevented from getting into the image forming section 3, jam recovery by the user becomes easy.

Although it has been stated that the holding current is passed through the registration motor M1 until the intermediate transfer belt 31 stops, a sufficiently longer time than the time until the intermediate transfer belt 31 stops may be set by allowing for variations among parts and variations in load inertia. In making such a setting, for example, the interval of time for the holding current passed through the registration motor M1 may be set constant.

With the above-described configuration, the image forming apparatus 1 according to the first embodiment has the following advantages. Since the detection sensor SN is placed on the sheet transport path P between the secondary transfer unit 4 and suction transport belt 42 and located away from the intermediate transfer belt 31, the image forming apparatus 1 according to the first embodiment can prevent a sensor surface of the detection sensor SN from being contaminated. This decreases misdetections made by the detection sensor SN. Since there is no need to take fluttering of the belt surface into consideration unlike a configuration which detects a sheet transported on the belt surface, it is easy to make settings as well as detections. Consequently, even when behavior of the sheet after secondary transfer is unstable, separation failure jams can be detected without increasing costs.

With the image forming apparatus 1 according to the first embodiment, a separation failure jam is determined when a predetermined transport time has elapsed, for example, when the leading edge of the sheet S reaches the belt surface of the suction transport belt 42. This decreases misdetections of separation failure jams of the sheets S, thereby improving detection accuracy of separation failure jams.

With the image forming apparatus 1 according to the first embodiment, holding torque is generated by passing the holding current through the stepping motor which is the registration motor M1 for a predetermined time during which the intermediate transfer belt 31 continues to move due to the inertial force and the like even after the registration motor M1 is stopped. Consequently, even after the registration motor M1 is stopped because of a separation failure jam, the sheet S is nipped and held by the registration roller pair 76, the sheet S is prevented from getting into the image forming section 3 or the like. Therefore, even when a separation failure jam occurs, the jammed sheet can be removed easily.

Second Embodiment

Figure 7A:
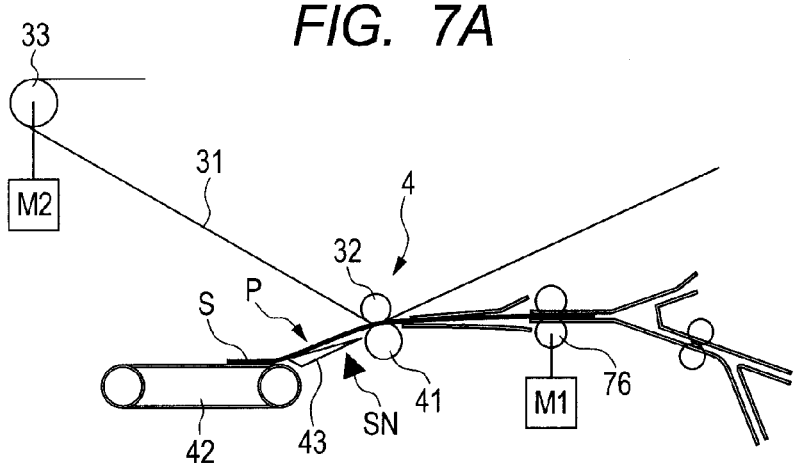
FIGS. 7A, 7B and 7C show a state in which three types of sheet differing in sheet size are transported through the secondary transfer unit.
Figure 7B:
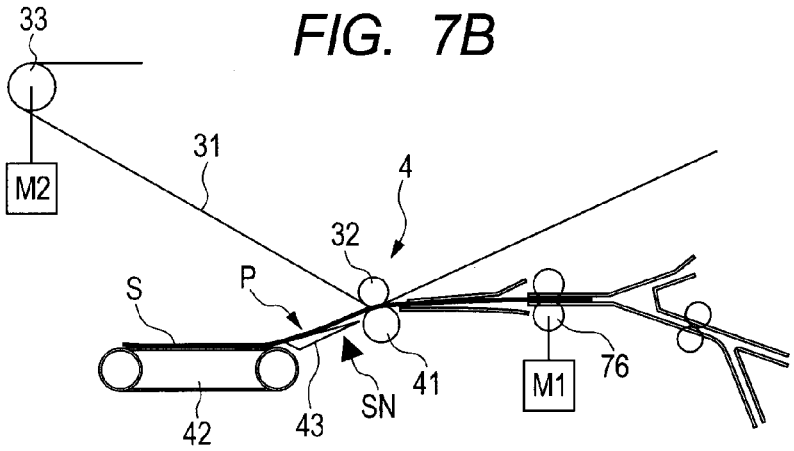
Figure 7C:
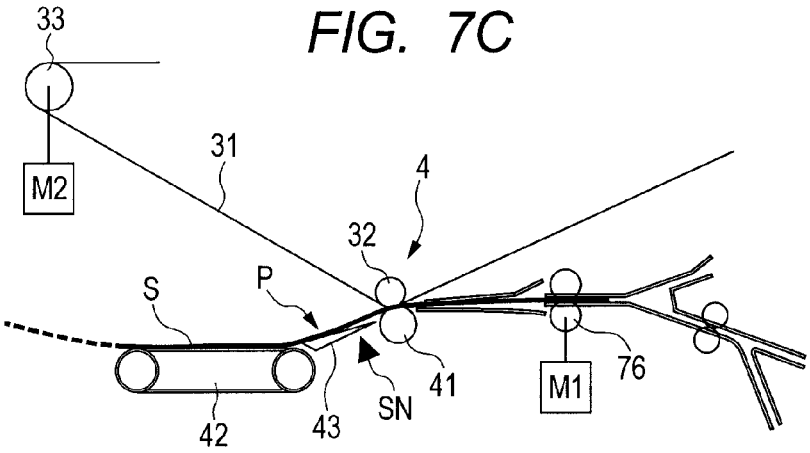
Figure 8:
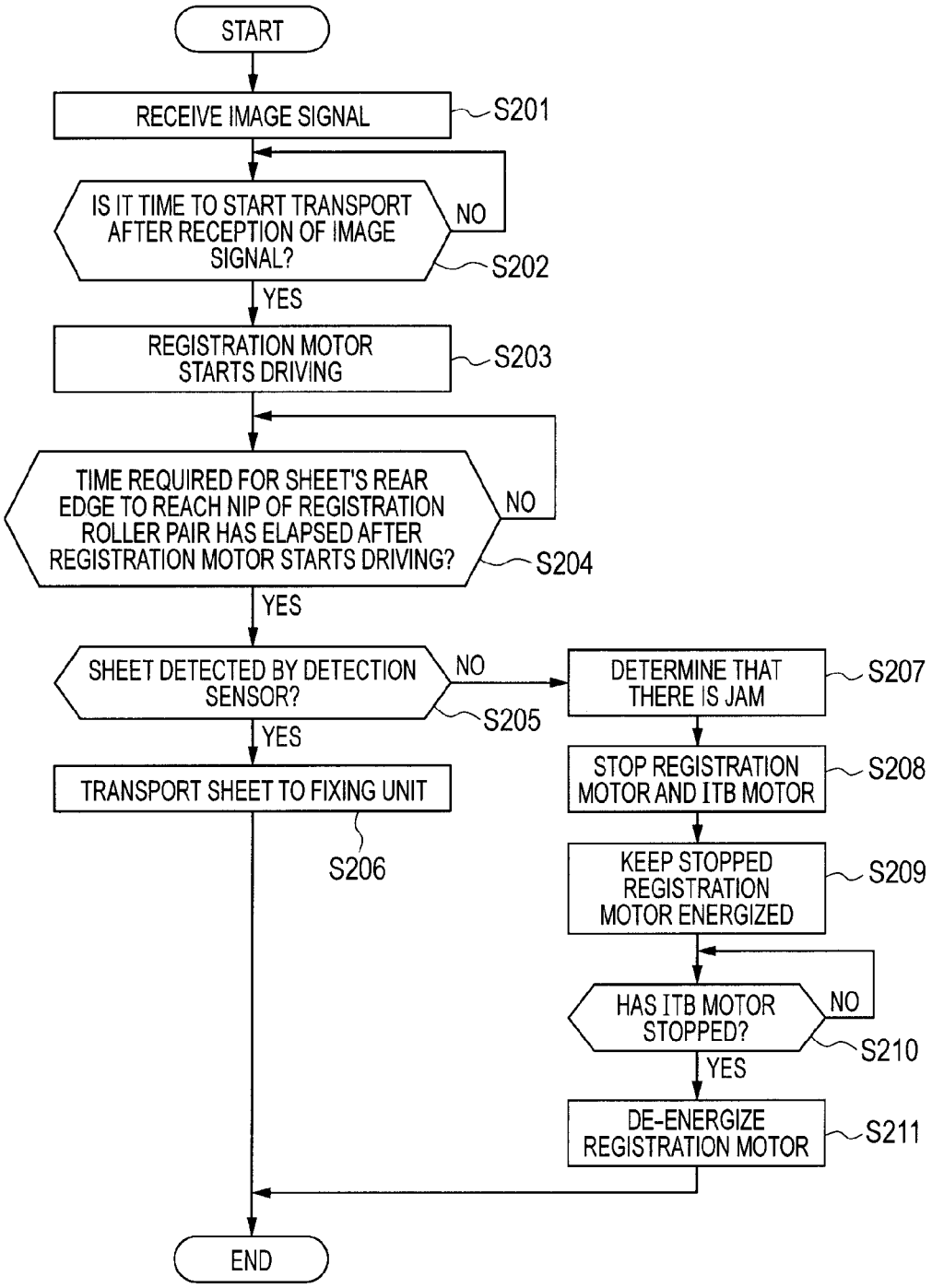
FIG. 8 is a flowchart showing stop control performed by a control unit according to a second embodiment in case of a separation failure jam.

An image forming apparatus 1 according to a second embodiment of the present invention will be described with reference to FIGS. 7A to 8. FIGS. 7A to 7C show a state in which three types of sheet differing in sheet size are transported through the secondary transfer unit 4. FIG. 8 is a flowchart showing stop control performed by a control unit 10 according to the second embodiment in case of a separation failure jam.

The image forming apparatus 1 according to the second embodiment differs from the first embodiment in the stop control performed by the control unit in case of a separation failure jam. Therefore, in the second embodiment, only differences from the first embodiment, i.e., the stop control performed by the control unit 10 in case of a separation failure jam, will be described, and the same components as corresponding components of the image forming apparatus 1 according to the first embodiment are denoted by the same reference numerals as the corresponding components and description thereof will be omitted. In the second embodiment, the same components as those in the first embodiment achieve effects similar to those of the corresponding components in the first embodiment.

When the image forming apparatus 1 starts a predetermined print job, a sheet S starts to be transported by a transport process by the sheet feeding unit 2 and the transported sheet S waits with its skew corrected by the registration roller pair 76. In parallel, image formation is started by the image forming process by the image forming section 3. When receiving a predetermined image signal (step S201), the control unit 10 waits for timing to start transporting the sheet S which has stopped at the registration roller pair 76 upon reception of the image signal (step S202). When timing to start transporting the sheet S occurs, the control unit 10 starts driving of the registration motor M1 and thereby transports the sheet S waiting at the registration roller pair 76 to the secondary transfer unit 4 (step S203).

Once the sheet S is transported to the secondary transfer unit 4 by the registration roller pair 76, a full-color toner image is secondarily transferred onto the sheet S by the secondary transfer unit 4, and the sheet S is further transported to the suction transport belt 42 installed downstream of the secondary transfer unit 4. The detection sensor SN adapted to detect the presence or absence of a sheet S is placed on the sheet transport path P between the secondary transfer unit 4 and suction transport belt 42, and the sheet S passing through the secondary transfer unit 4 is transported to above the detection sensor SN placed on the sheet transport path P by being guided by the lower guide 43.

The control unit 10 calculates an expected time from when the registration motor M1 starts driving to when the rear edge of the sheet S reaches a position spaced apart from the nip of the registration roller pair 76 at a predetermined distance (a position upstream of the registration roller pair 76 and in the vicinity of the registration roller pair 76). Then, the control unit 10 determines whether or not the expected time calculated has elapsed (step S204). At the time point (timing) when the expected time elapses, the control unit 10 causes the detection sensor SN to detect the presence or absence of a sheet S (step S205). When the detection sensor SN detects the sheet S on the sheet transport path P, the sheet S is transported as it is to the fixing unit 5 (step S206), and thereby the predetermined print job is finished.

The predetermined distance (the position upstream of the registration roller pair 76 and in the vicinity of the registration roller pair 76) is determined by allowing for variations in transport speed of sheet and downtime of the registration motor M1. That is, the distance is set such that the rear edge of the sheet S will remain clamped in the nip of the registration roller pair 76 even after the registration motor M1 stops. For example, the predetermined distance is a distance from the nip of the registration roller pair 76 to the rear edge of the sheet S and is 30 mm. The expected time is calculated based on this distance.

Processes when the control unit 10 determines that there is a separation failure jam (steps S207 to S211) are the same as those in the first embodiment (steps S107 to S111), and thus description thereof will be omitted.

As in the case of the first embodiment, a separation failure jam may be checked for once in relation to the leading edge of the sheet S, and then a separation failure jam may be checked for again when the rear edge of the sheet S reaches the position spaced apart at the predetermined distance (the sheet S reaches the position upstream of the registration roller pair 76 and in the vicinity of the registration roller pair 76).

With the above-described configuration, the image forming apparatus 1 according to the second embodiment has the following advantages in addition to the advantages achieved by the same components as the first embodiment. With the image forming apparatus 1 according to the second embodiment, a separation failure jam is determined for when a predetermined transport time has elapsed, for example, when the rear edge of the sheet S reaches the position spaced apart from the nip of the registration roller pair 76 at a predetermined distance after the registration motor M1 starts driving. Therefore, stop position of the leading edge varies with the sheet size, but in the case of a long sheet, a separation failure jam can be checked for with later timing. Consequently, for example, even when the behavior of the sheet is unstable, a separation failure jam can be determined for when misdetection is less likely to occur within a range in which holding torque (braking) can be applied by the registration roller pair 76 (see FIGS. 7A to 7C). This is especially effective when there is no mechanism, such as the suction transport belt 42, which transports the sheet S by reliably sucking the leading edge of the sheet S, immediately downstream of the secondary transfer unit 4.

Third Embodiment

In a third embodiment, description will be given of a case in which the post-transfer sensor SN has multiple sensors including a lever sensor SN1 and reflective optical sensor SN2, and a separation failure jam is checked by the multiple sensors. The configuration of the apparatus as well as the sheet transport process, image forming process, secondary transfer process and subsequent processes thereof are similar to those of the first embodiment, and thus description thereof will be omitted.

Figure 9:
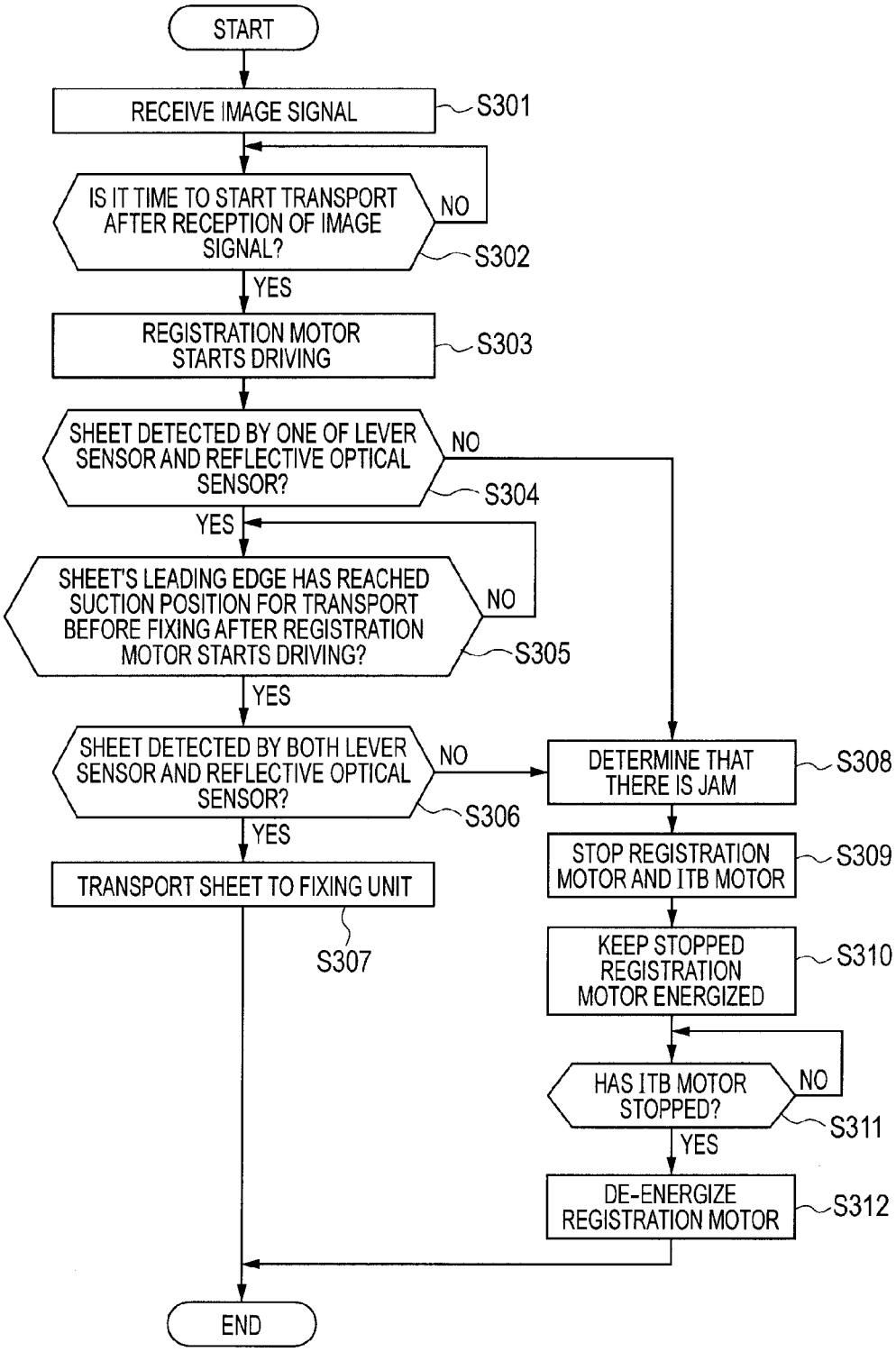
FIG. 9 is a flowchart showing stop control performed by a control unit according to a third embodiment in case of a separation failure jam.
Figure 10:
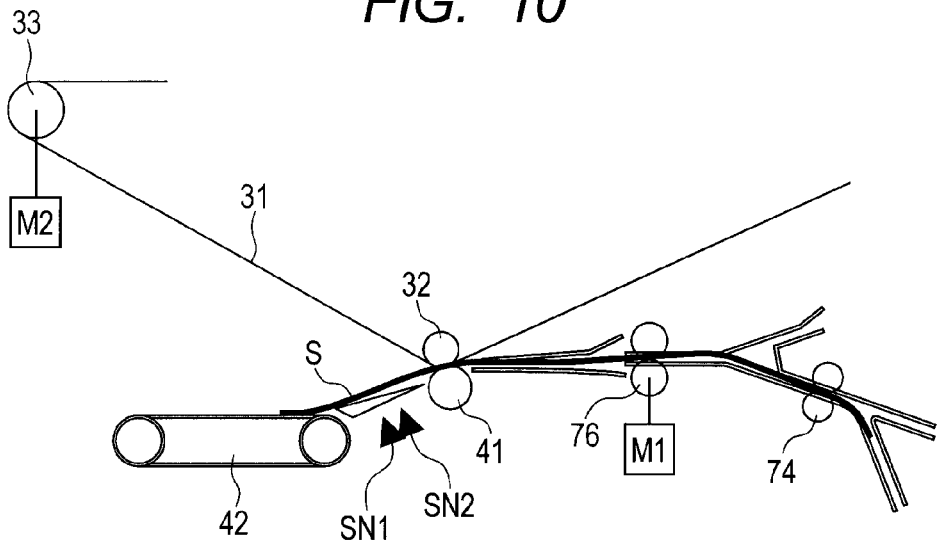
FIG. 10 is a partial sectional view of a secondary transfer unit of an image forming apparatus according to the third embodiment.
Figure 11:
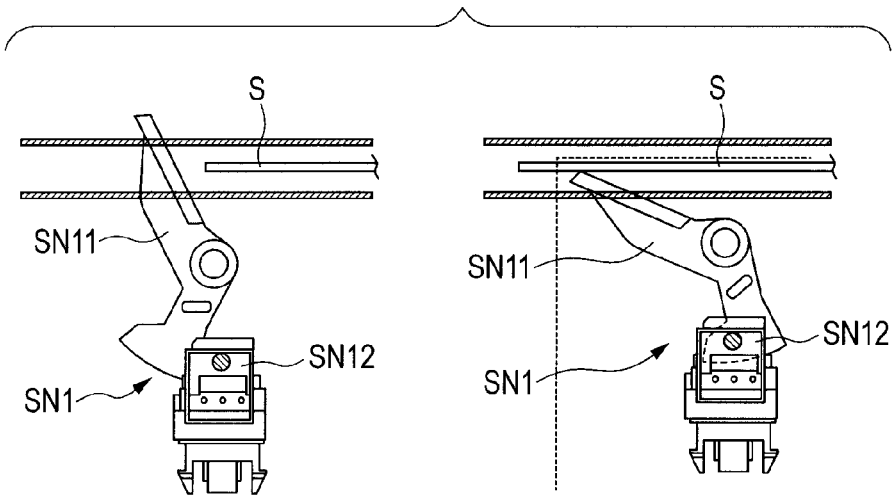
FIG. 11 is a schematic diagram of a lever sensor SN1 according to the third embodiment.
Figure 12:
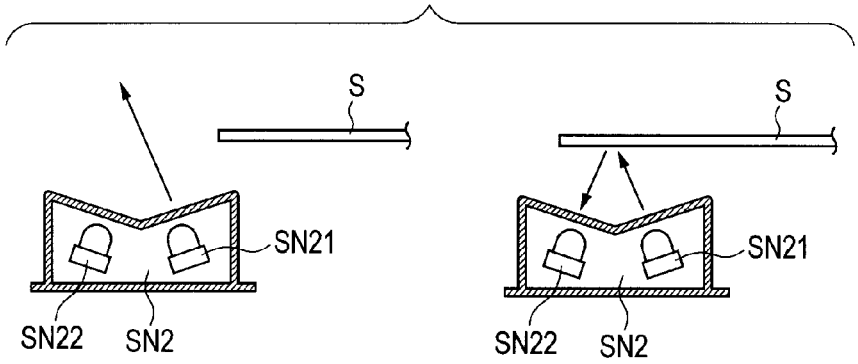
FIG. 12 is a schematic diagram of a reflective optical sensor SN2 according to the third embodiment.

FIG. 9 shows a flowchart related to the third embodiment, FIG. 10 shows a partial sectional view of a secondary transfer unit, FIG. 11 shows a schematic diagram of the lever sensor SN1, and FIG. 12 shows a schematic diagram of the reflective optical sensor SN2. According to the present embodiment, at the time point when the leading edge of the sheet S reaches the suction transport belt surface of the suction transport belt 42, it is determined whether or not the sheet S has been detected by the detection sensor SN again. Description will be given of a case in which the apparatus is stopped when the sheet S has not been detected and it is determining that there is a separation failure jam. Even when a separation failure jam is checked for by detecting rear edge position of the sheet S, equivalent effects can be obtained when a separation failure jam is checked for using multiple sensors including the lever sensor SN1 and reflective optical sensor SN2.

When the image forming apparatus 1 starts a predetermined print job, a sheet S starts to be transported by a transport process by the sheet feeding unit 2 and the transported sheet S waits with its skew corrected by the registration roller pair 76. In parallel, image formation is started by the image forming process by the image forming section 3. When the control unit 10 receives a predetermined image signal (step S301), the control unit 10 waits for timing to start transporting the sheet S which has stopped at the registration roller pair 76 upon reception of the image signal (step S302). When timing to start transporting the sheet S occurs, the control unit 10 starts driving of the registration motor M1 (step S303) and thereby transports the sheet S waiting at the registration roller pair 76 to the secondary transfer unit 4.

Once the sheet S is transported to the secondary transfer unit 4 by the registration roller pair 76, a full-color toner image is secondarily transferred onto the sheet S by the secondary transfer unit 4, and the sheet S is transported to the suction transport belt 42 installed downstream of the secondary transfer unit 4. The detection sensor SN adapted to detect the presence or absence of a sheet S is placed on the sheet transport path P between the secondary transfer unit 4 and suction transport belt 42, and the sheet S passing through the secondary transfer unit 4 is guided by the lower guide 43 and transported to above the detection sensor SN placed on the sheet transport path P.

Once a full-color toner image is secondarily transferred onto the sheet S by the secondary transfer unit 4, the sheet S is transported to the fixing unit 5 installed downstream. According to the present embodiment, as shown in FIG. 10, between the secondary transfer unit 4 and fixing unit 5, the lever sensor SN1 and the reflective optical sensor SN2 are placed downstream of the secondary transfer unit 4 and in the vicinity of the secondary transfer unit 4, the suction transport belt 42 is placed further downstream thereof. The lever sensor SN1 and reflective optical sensor SN2 are placed at almost the same position as shown in FIG. 10.

As shown in FIG. 11, the lever sensor SN1 includes a sensor lever SN11 adapted to turn and change posture when the transported sheet S abuts it, and a detection unit SN12 adapted to output an ON/OFF signal in response to the posture change of the sensor lever SN11. On the other hand, as shown in FIG. 12, the reflective optical sensor SN2 includes a light-emitting element SN21 and light-receiving element SN22. When no sheet S is being transported, light emitted by the light-emitting element SN21 does not return as a reflection, and consequently the reflective optical sensor SN2 outputs an OFF signal. When there is a sheet S, the light emitted by the light-emitting element SN21 returns by reflecting off the sheet S, and consequently the reflective optical sensor SN2 outputs an ON signal. The control unit 10 determines the presence or absence of a transported sheet S, based on the signals from the lever sensor SN1 and reflective optical sensor SN2.

The sheet S passing through the secondary transfer unit 4 is transported to the lever sensor SN1 and above the reflective optical sensor SN2. The control unit 10 determines whether to stop the apparatus as a case of a separation failure jam or not, based on whether or not the reflective optical sensor SN2 has detected the leading edge of the sheet S within a predetermined time after the registration motor M1 starts driving (step S304).

The predetermined time is determined from the nominal time required for the sheet S to be transported above the reflective optical sensor SN2 after the registration motor M1 starts driving, by allowing for variations listed below:

(1) sheet transport speed variations due to part tolerances of the registration rollers in terms of external shape, (2) sheet transport speed variations due to decreases in the surface resistance of the registration rollers resulting from wear, (3) variations in the time of arrival at the reflective optical sensor SN2 caused by a transport passage path in the transport path, and (4) sheet transport speed variations due to differences in resistance between a transport guide and sheets resulting from differences in the rigidity among the sheets S.

The predetermined time is determined by adding a margin time (e.g., 60 msec) to a nominal time, where the margin time is determined by allowing for the variations listed above. The reason why a jam check is carried out using the reflective optical sensor SN2 will be described later.

When the reflective optical sensor SN2 detects the leading edge of sheet within the predetermined time, the sheet S is sent to the suction transport belt 42. The control unit 10 calculates the time from when the registration motor M1 starts driving to when the leading edge of the sheet S reaches the suction transport belt surface of the suction transport belt 42 and waits until the calculated time elapses (step S305). At the time point when the calculated time elapses, the control unit 10 checks whether or not the lever sensor SN1 and reflective optical sensor SN2 have detected the sheet S (step S306). When both the lever sensor SN1 and reflective optical sensor SN2 have detected the sheet S, the sheet S is transported to the fixing unit 5 (step S307). When any of the sensors has not detected the sheet S, the control unit 10 determines that there is a jam (step S308).

Recently, since an image forming apparatus has been required high productivity, an image forming apparatus has been proposed which achieve high productivity by accelerating image forming speed for a sheet S and reducing the sheet-to-sheet distance between preceding sheet and subsequent sheet (distance between the rear edge of the preceding sheet and leading edge of the subsequent sheet). With image forming apparatus with such high productivity, for example, if the image forming speed for a sheet S is set to 350 mm/sec and the sheet-to-sheet distance between the preceding sheet and subsequent sheet is set to 25 mm, an sheet-to-sheet time (interval of time from when the rear edge of the preceding sheet leaves a position to when the leading edge of the subsequent sheet reaches the same position) is as short as 71 msec. The lever sensor SN1 detects the subsequent sheet after the preceding sheet leaves. Therefore, it is necessary to restore a posture of the sensor lever SN11 and the sensor lever SN11 needs to restore its posture in a shorter time than the sheet-to-sheet distance.

Normally, the sensor lever SN11 of the lever sensor SN1 changes posture by coming into contact with the leading edge of the sheet, and the presence or absence of a sheet S is detected through detection of changes in the posture of the sensor lever SN11. Therefore, to avoid damaging a passing sheet and reduce a transport load, spring pressure applied to maintain the posture of the sensor lever SN11 is set to be as weak as possible. Consequent, interval of time to restore the posture of the sensor lever SN11 can take approximately 100 msec, and it is longer than the sheet-to-sheet time. Thus, as shown in steps S301 to S304, in the image forming apparatus with high productivity, a jam check at the leading edge of the sheet can be carried out by the reflective optical sensor SN2 which does not need the interval of time to restore the posture of lever posture.

In the case where the second side of a sheet is detected, white part in blank space on the leading edge of the sheet can be detected reliably by the reflective optical sensor SN2, but to perform the second detection, it is necessary to detect a part which carries a toner image transferred and fixed on the first side facing the sensor. Especially, when the toner on the sheet is black, a small amount of light is reflected off the sheet, making it is difficult to set a threshold for identification of the sheet S and resulting in a higher tendency for misdetection to occur. Therefore, to reliably detect the presence or absence of a sheet S carrying toner without misdetection, the lever sensor SN1 is more suitable.

Thus, according to the present embodiment, the jam check on the leading edge of the sheet is carried out using the reflective optical sensor SN2 and the second jam check is carried out using both the lever sensor SN1 and reflective optical sensor SN2. Although in the present embodiment, both sensors are used in the second jam check to eliminate misdetection, only the lever sensor SN1 may be used alternatively.

Flowchart of detecting the leading edge of the sheet S once with the reflective optical sensor SN2 and carrying out a jam check again, and flowchart of performing the second detection when the leading edge of the sheet S reaches the suction transport belt surface of the suction transport belt 42 are the same as S105 to S106 according to the first embodiment, and thus description thereof will be omitted. Steps S308 to S312 of the flowchart which describe the stop control performed when it is determined that there is a separation failure jam are also the same as steps S108 to S112 according to the first embodiment, and thus description thereof will be omitted.

As described above, according to the third embodiment, in an image forming apparatus with high productivity which forms images on sheets using an intermediate transfer belt with short sheet-to-sheet time, separation failure jams can be detected reliably even if the behavior of the sheet after secondary transfer is unstable. Also, the image forming apparatus, from which the sheet S that has caused a separation failure jam is removed reliably, can be provided. The configuration of the third embodiment may be applied to the detection of separation failure jams according in the second embodiment.

Fourth Embodiment

Next, a fourth embodiment of the present invention, involving a configuration to allow a registration roller pair to be spaced away from each other, will be described. The image forming process, secondary transfer process, subsequent processes thereof, and stop control performed in case of separation failure jam of a sheet are similar to those of the first embodiment, and thus description thereof will be omitted.

If the paper cassettes 61 to 64 are displaced with respect to the image in a direction (hereinafter referred to as the "width direction") perpendicular to the sheet transport direction or placed obliquely, the sheets sent out from the paper cassettes 61 to 64 will be displaced in the width direction or skewed. Furthermore, the sheets fed from the paper cassettes 61 to 64 might be displaced in the width direction or skewed during transport. Any width-direction displacement or skew of the sheets supplied to the secondary transfer unit 4 might result in displacement of image printing position with respect to the sheets.

To further improve image print accuracy compared to the configuration of the first embodiment, the present embodiment adopts a configuration which performs position correction in the width direction of the sheet by shifting the registration roller pair 76 in addition to the skew correction by abutment of the leading edge of the sheet. A shifting mechanism of the registration roller pair 76 will be described in detail later. In a continuous paper feed job, after position correction in the width direction of the sheet is performed and before the subsequent sheet is transported to the registration roller pair 76, the registration roller pair 76 needs to be returned to a predetermined home position (hereinafter referred to as the "HP") which is a position before the shifting. In a continuous paper feed job, when the registration roller pair 76 is returned to the HP after the sheet S which undergoes position correction in the width direction of the sheet passes through the registration roller pair 76, a problem of decreased productivity arises. To deal with this, before the registration roller pair 76 is returned to the HP, the registration roller pair 76 is spaced away from each other with predetermined timing while the sheet S is transported by the registration roller pair 76 and transfer unit 4. Regarding the spacing of the registration roller pair 76, it is intended not only to return the registration roller pair 76 to the HP, but also to reduce distortion of the image and the sheet caused by misalignment or pressure imbalance of the registration roller pair 76 and secondary transfer roller 41.

Figure 13A:
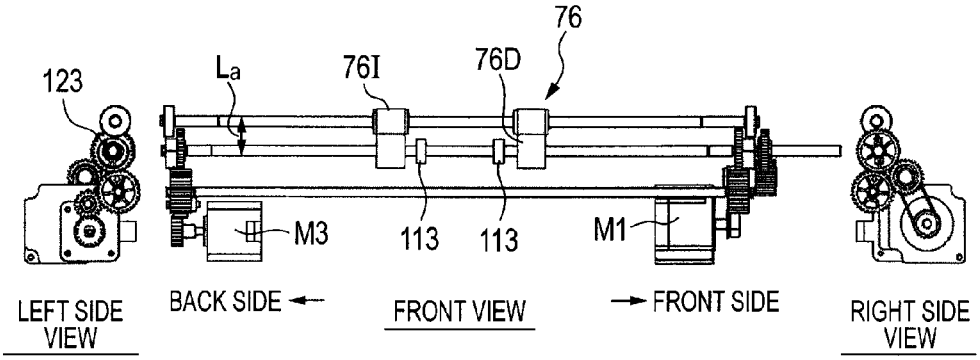
FIGS. 13A and 13B show a spacing mechanism according to a fourth embodiment, where the spacing mechanism spaces a registration roller pair away from each other.
Figure 13B:
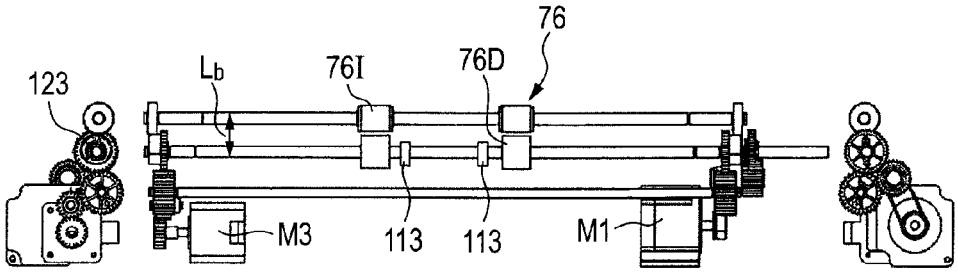

A spacing mechanism of the registration roller pair 76 will be described below with reference to FIGS. 11 to 13. FIG. 13A shows a state in which the registration roller pair 76 forms a nip by being placed in pressing contact with each other. FIG. 13B shows a state in which the registration roller pair 76 is spaced away from each other, opening the nip. The registration roller pair 76 is configured to be driven by the registration roller motor M1. A registration driven roller 76I is driven to rotate by following a registration drive roller 76D.

The registration driven roller 76I is urged in a direction approaching the registration drive roller 76D by a registration roller pressure spring 113. When a registration roller pair spacing motor M3 holds a cam gear 123 at a position shown in FIG. 13A, a center distance of the registration roller pair 76 becomes La and the nip of the registration roller pair 76 is formed. When the registration roller pair spacing motor M3 holds the cam gear 123 at a position shown in FIG. 13B, the center distance of the registration roller pair 76 becomes Lb (>La) and the nip of the registration roller pair 76 is opened.

A width detection sensor such as a CCD is installed upstream or downstream of the registration roller pair 76 in the sheet transport direction to detect a position of the transported sheet S in the width direction. Based on a detection signal from the width detection sensor adapted to detect the position in the width direction of the sheet S being transported with its skew having been corrected by the registration roller pair 76, the control unit 10 detects an amount of displacement in the width direction between the sheet S and the image transferred by the secondary transfer unit 4. To correct a displacement amount in the width direction between the sheet S and the image, the registration roller pair 76 shifts in the width direction in a state of nipping the sheet S so as to eliminate the displacement in the width direction. This enables improving image location accuracy by preventing the displacement between the sheet S and the image transferred onto the sheet S by the secondary transfer unit 4. After the displacement in the width direction of the sheet is corrected, the registration roller pair 76 returns to the HP with predetermined timing to correct displacement of the subsequent sheet.

Figure 14:
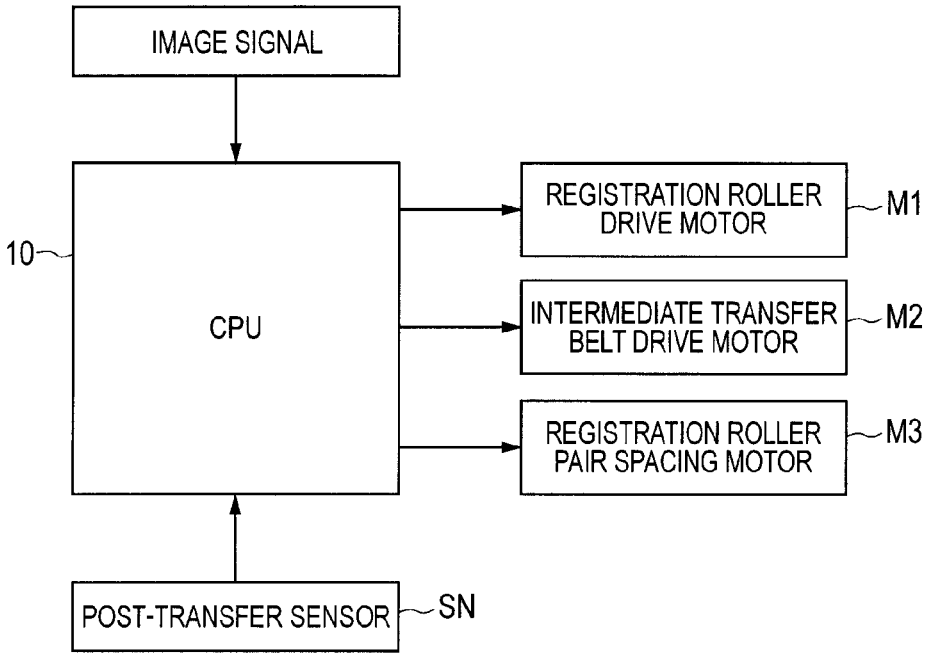
FIG. 14 is a block diagram of a control unit which performs stop control in case of a separation failure jam in an image forming apparatus according to the fourth embodiment.
Figure 15:
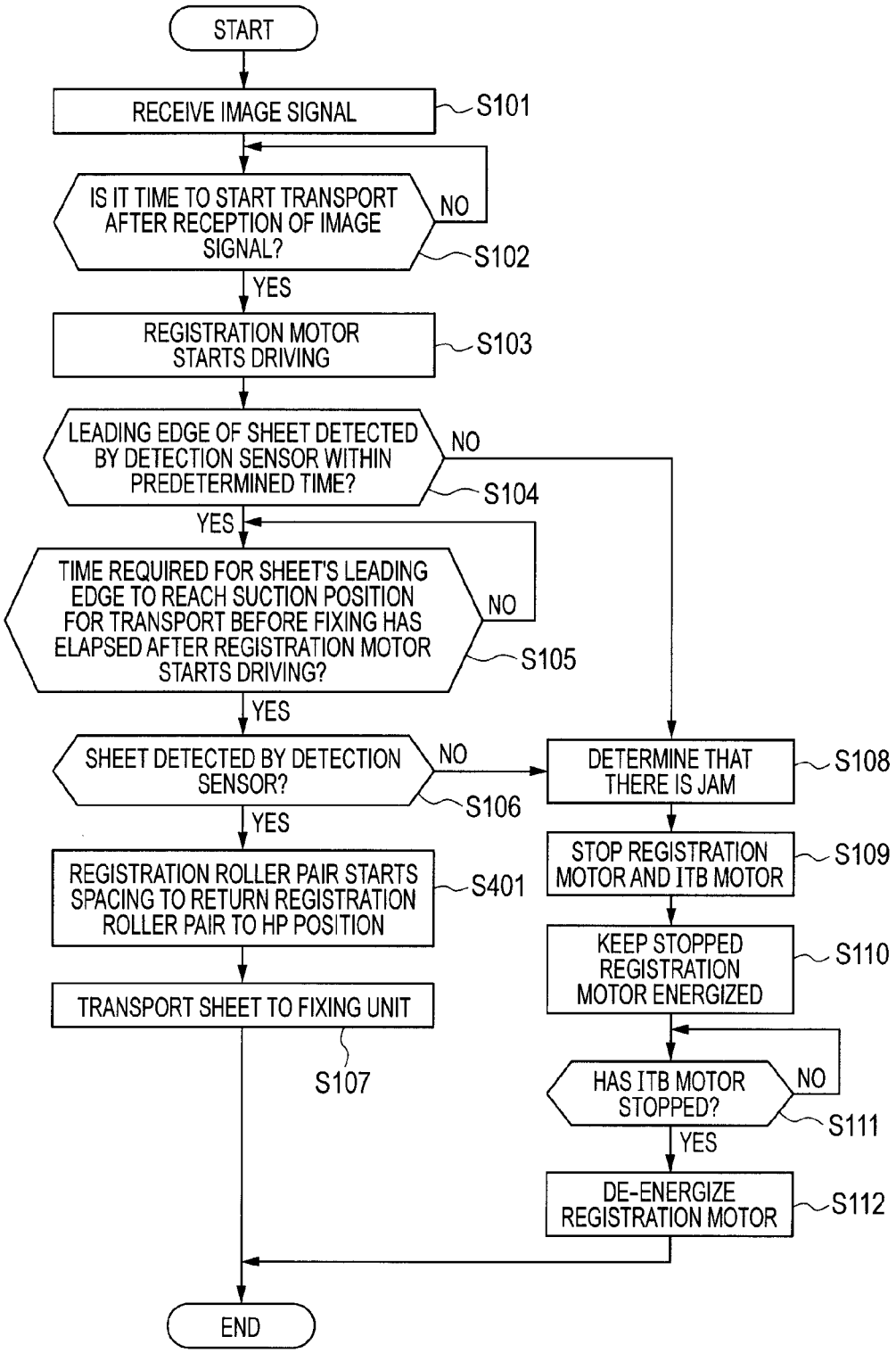
FIG. 15 is a flowchart showing stop control performed by the control unit according to the fourth embodiment in case of a separation failure jam.

FIG. 14 is a block diagram related to control according to the present embodiment, where the block diagram differs from the block diagram of FIG. 5 in that the registration roller pair spacing motor M3 of the registration roller pair 76 is connected to the control unit 10. Next, the control according to the present embodiment based on FIG. 14 will be described with reference to a flowchart of FIG. 15. Steps S101 to S106 and steps S108 to S112 are the same as those in the flowchart (FIG. 6) according to the first embodiment, and thus description thereof will be omitted.

When a sheet sticks to the intermediate transfer belt 31 in a case of a separation failure jam, the control unit 10 stops the registration roller pair 76 to prevent the sheet from getting into the image forming section 3 (steps S108 to S112), as in the case of the first embodiment. When there is no separation failure jam, after the detection sensor SN detects a sheet S, the registration roller pair 76 is spaced away from each other by the spacing mechanism and then shifted so as to return to the HP (step S401). The sheet S is sent to the fixing unit 5 and then the toner image is fixed (step S107).

The fourth embodiment has advantages similar to those of the first embodiment. The control performed by the spacing mechanism of the registration roller pair 76 according to the fourth embodiment may be applied to the configurations of the second and third embodiments.

Fifth Embodiment

In comparison to the fourth embodiment, description will be given of a fifth embodiment in which the registration roller pair 76 is spaced away from each other and returned to the HP before the detection sensor SN detects separation failure jam. The fifth embodiment differs from the fourth embodiment in the timing to space the registration roller pair 76 away from each other and in the stop control performed in case of a separation failure jam.

Figure 16:
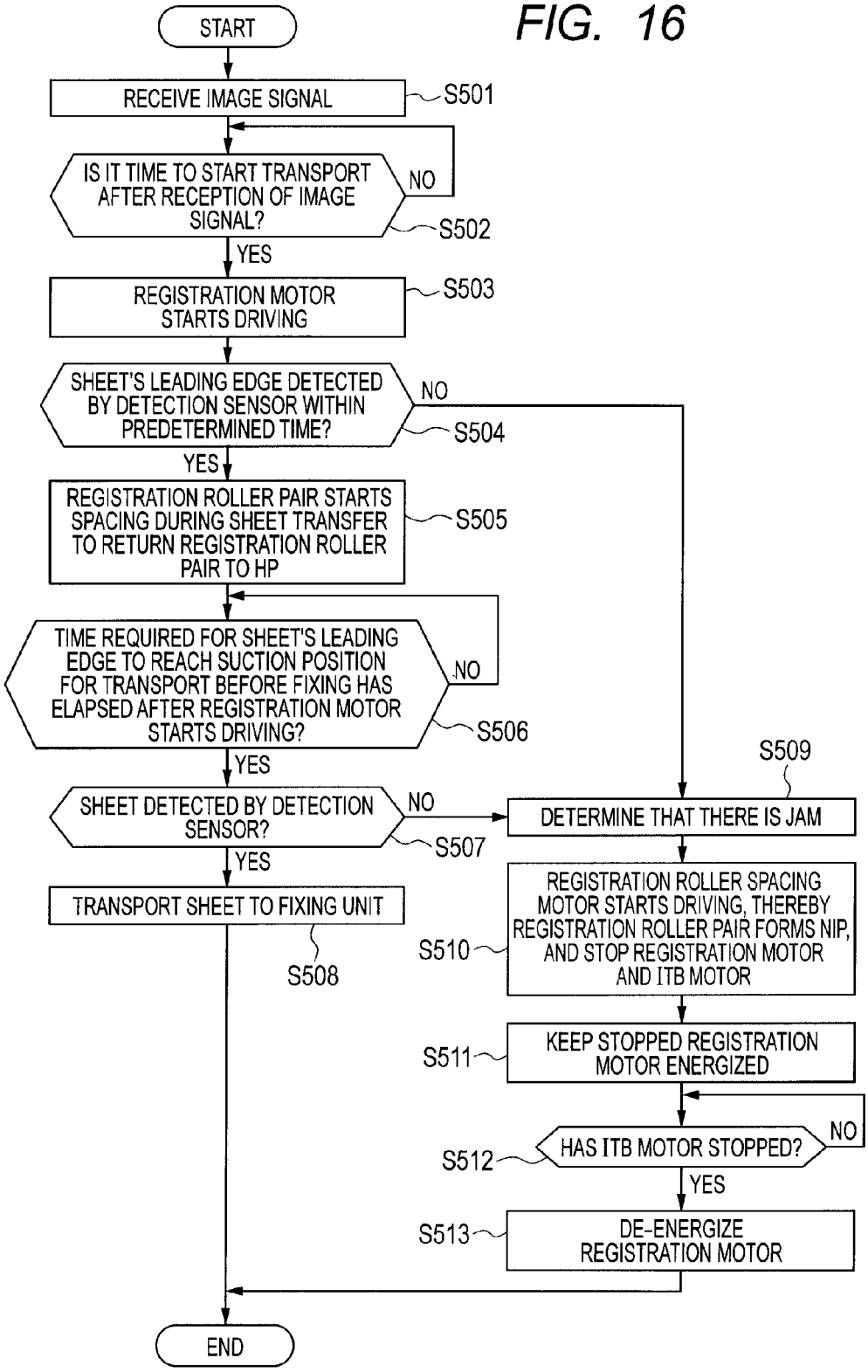
FIG. 16 is a flowchart showing stop control performed by a control unit according to a fifth embodiment in case of a separation failure jam.

The stop control performed in case of a separation failure jam will be described with reference to the partial sectional view of the secondary transfer unit in FIG. 10 and a flowchart in FIG. 16. Steps S501 to S504 are the same as steps S101 to S104 according to the first embodiment.

The sheet S passing through the secondary transfer unit 4 is transported to above the detection sensor SN. The control unit 10 determines whether or not to stop the apparatus as a case of a jam, based on whether or not the detection sensor SN has detected the leading edge of the sheet within a predetermined time after the registration motor M1 starts driving.

When the detection sensor SN detects the leading edge of the sheet, the control unit 10 determines that the sheet S is not jammed. Consequently, the control unit 10 starts driving of a registration roller spacing motor M and thereby spaces the registration roller pair 76 away from each other. In this case, the registration roller pair 76 is spaced away from each other after jamming of the sheet S is checked by the detection sensor SN. However, as long as the sheet is transported by the secondary transfer unit 4, the timing to space the registration roller pair 76 away from each other is arbitrary. The control unit 10 causes the registration roller pair 76 to shift and return to the HP (step S505).

When the detection sensor SN detects the leading edge of the sheet S within a predetermined time, the sheet S is transported as it is toward the suction transport belt 42. Next, the control unit 10 calculates the time from when the registration motor M1 starts driving to when the leading edge of the sheet S reaches the belt surface of the suction transport belt 42. Then, the control unit 10 determines whether or not the calculated time has elapsed (step S506).

At the time point (timing) when the calculated time has elapsed, the control unit 10 causes the detection sensor SN to detect the presence or absence of a sheet S again (step S507). When the detection sensor SN detects that there is a sheet S, the sheet S is transported as it is to the fixing unit 5 (step S508), and thereby the predetermined print job is finished. After the leading edge of the sheet S is detected once with the detection sensor SN, detection is performed by the detection sensor SN again to check for a jam, as with the first embodiment.

When the detection sensor SN does not detect the leading edge of the sheet S within the predetermined time in steps S504 and S507, the control unit 10 determines that there is a separation failure jam (step S509). Upon making the determination, the control unit 10 immediately starts driving of the registration roller spacing motor M and thereby causes the registration roller pair 76 to form a nip. Furthermore, the control unit 10 stops pulse input to the stepping motor which is the registration motor M1 and stops the ITB motor M2 as well (step S510).

Then, even after stopping the pulse input to the stepping motor which is the registration motor M1, the control unit 10 keeps the stepping motor energized by passing a holding current through the stepping motor and thereby generates holding torque as predetermined torque (step S511). Then, the control unit 10 stops the sheet S which has caused a separation failure jam, by nipping the sheet S in the nip of the registration roller pair 76.

The control unit 10 determines whether or not the predetermined time required to stop the ITB motor M2 which drives the intermediate transfer belt 31 has elapsed (step S512). When the predetermined time has elapsed, the control unit 10 stops energizing the registration motor M1 (step S513). This allows the jammed and stopped sheet S to be pulled out from the nip of the registration roller pair 76.

The fifth embodiment has advantages similar to those of the first embodiment. The control performed by the spacing mechanism of the registration roller pair 76 according to the fifth embodiment may be applied to the configurations of the second and third embodiments.

Embodiments of the present invention have been described above, but the present invention is not limited to the embodiments described above. Also, only major advantages of the present invention have been listed in the above embodiments, and the advantages of the present invention are not limited to those described in the embodiments.

For example, although in the first embodiment the leading edge of the sheet S is detected once by the detection sensor SN and then detected by the detection sensor SN again with predetermined timing, the present invention is not limited to this. For example, by omitting the first jam check at the leading edge of the sheet S, only the second jam check may be carried out at the timing when the leading edge of the sheet S reaches the suction transport belt surface of the suction transport belt 42.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-026764, filed Feb. 10, 2011, which is hereby incorporated by reference herein in its entirety.

What is claimed is:

1. An image forming apparatus comprising:

a transfer belt bearing a toner image and rotating;

a transfer unit transferring the toner image, which is born on the transfer belt, onto a sheet;

a roller pair transporting the sheet to the transfer unit;

a stepping motor rotating the roller pair according to pulse input to the stepping motor;

a detection unit detecting the transported sheet downstream of the transfer unit in a sheet transport direction; and a changing unit changing, based on a detection result of the detection unit, a first state in which the pulse is input to the stepping motor for rotating the roller pair to a second state in which current flows into the stepping motor without inputting the pulse to the stepping motor so as to stop rotation of the roller pair.

2. The image forming apparatus according to claim 1, further comprising:

a transporting unit transporting the sheet and located downstream of a detection position, where the detection unit detects the sheet in the sheet transport direction, wherein the changing unit changes the first state to the second state if the detection unit does not detect the sheet at an expected time at which the transporting unit transports the sheet.

3. The image forming apparatus according to claim 1, wherein the changing unit changes the first state to the second state if the detection unit does not detect the sheet at an expected time at which a rear edge of the sheet is spaced apart from a nip of the roller pair at a predetermined distance.

4. The image forming apparatus according to claim 1, wherein the changing unit changes the first state to the second state if the detection unit does not detect the sheet when a predetermined time has elapsed from starting transportation of the sheet by the transporting unit.

5. The image forming apparatus according to claim 1, wherein the changing unit changes the second state to a third state, in which the current does not flow into the stepping motor, when a predetermined time has elapsed from changing the first state to the second state.

6. The image forming apparatus according to claim 1, further comprising:

a transporting unit transporting the sheet and located downstream of a detection position, where the detection unit detects the sheet in the sheet transport direction; and a separation unit separating one of the roller pair apart from another of the roller pair when the detection unit detects the sheet at an expected time at which the transporting unit transports the sheet.

7. The image forming apparatus according to claim 1, further comprising:

a fixing unit fixing the toner image, which is transferred onto the sheet by the transferring unit, onto the sheet; and a transport belt located between the transferring unit and the fixing unit, with the sheet suctioned onto an upper surface of the transport belt and transported to the fixing unit, wherein the changing unit changes the first state to the second state if the detection unit does not detect the sheet at an expected time at which the sheet transported by the transfer unit reaches the transport belt and does not reach the fixing unit.

8. The image forming apparatus according to claim 1, further comprising:

a drive unit which rotates the transfer belt, wherein the drive unit is stopped and the changing unit changes the first state to the second state if the detection unit does not detect the sheet at a predetermined timing.

9. The image forming apparatus according to claim 1, further comprising:

a drive unit which rotates the transfer belt, wherein the current flows into the stepping motor until rotation of the transfer belt is stopped after the drive unit is stopped based on the detection result of the detection unit, with the current flow into the stepping motor stopped after the rotation of the transfer belt is stopped.

10. An image forming apparatus comprising: a transfer belt bearing a toner image and rotating;

a transfer unit transferring the toner image, which is born on the transfer belt, onto a sheet;

a roller pair transporting the sheet to the transfer unit;

a stepping motor rotating the roller pair according to pulse input to the stepping motor;

a detection unit detecting the transported sheet downstream of the transfer unit in a sheet transport direction; and a control unit for controlling, if the detection unit does not detect the sheet when a predetermined time has elapsed from starting rotation of the roller pair for transporting the sheet, current flow such that current is flowing into the stepping motor without inputting the pulse to the stepping motor so as to stop rotation of the roller pair.

11. The image forming apparatus according to claim 10, further comprising:

a transporting unit transporting the sheet and located downstream of a detection position, where the detection unit detects the sheet in the sheet transport direction, wherein the predetermined time is set so that transportation of the sheet by the transporting unit is expected to start when the predetermined time has elapsed from starting the rotation of the roller pair.

12. The image forming apparatus according to claim 10, wherein the predetermined time is set so that a rear edge of the sheet is spaced apart from a nip of the roller pair at a predetermined distance when the predetermined time has elapsed from starting the rotation of the roller pair.

13. The image forming apparatus according to claim 10, wherein the control unit stops the current flow into the stepping motor after flowing the current into the stepping motor without inputting the pulse to the stepping motor during a second predetermined time.

14. The image forming apparatus according to claim 10, further comprising:

a transporting unit transporting the sheet and located downstream of a detection position, where the detection unit detects the sheet in the sheet transport direction; and a separation unit separating one of the roller pair apart from another of the roller pair when the detection unit detects the sheet at an expected time at which the transporting unit transports the sheet.

15. The image forming apparatus according to claim 10, further comprising:

a fixing unit fixing the toner image, which is transferred onto the sheet by the transferring unit, onto the sheet; and a transport belt placed between the transferring unit and the fixing unit, with the sheet sunctioned onto an upper surface of the transport belt to transport the sheet to the fixing unit, wherein the predetermined time is set so that the sheet transported by the transfer unit reaches the transport belt and does not reach the fixing unit when the predetermined time has elapsed from starting the rotation of the roller pair.

16. The image forming apparatus according to claim 10, further comprising:

a drive unit which rotates the transfer belt, wherein, if the detection unit does not detect the sheet at a predetermined timing, the control unit stops the drive unit and flows the current into the stepping motor without inputting the pulse to the stepping motor so as to stop rotation of the roller pair.

17. The image forming apparatus according to claim 10, further comprising:

a drive unit which rotates the transfer belt, wherein the control unit stops flow of the current into the stepping motor after rotation of the transfer belt is stopped by stopping the drive unit.

* * * * *